United States Patent [19]

Lee et al.

[11] Patent Number: 4,818,958

[45] Date of Patent: Apr. 4, 1989

[54] COMPACT DUAL SERIES WAVEGUIDE FEED

[75] Inventors: Kuan M. Lee, Brea; William L. Lange, Placentia; Stan W. Livingston, Anaheim, all of Calif.

[73] Assignee: Hughes Aircraft Company, Los Angeles, Calif.

[21] Appl. No.: 133,703

[22] Filed: Dec. 16, 1987

[51] Int. Cl.[4] ..... H01P 5/18

[52] U.S. Cl. ..... 333/114; 333/137; 333/157; 343/853; 343/778; 342/153

[58] Field of Search ..... 333/109, 113, 114, 117, 333/125, 136, 137, 157; 343/771, 776–778, 853; 342/153, 152, 149

[56] References Cited

U.S. PATENT DOCUMENTS

| | | | |
|---|---|---|---|
| 2,667,620 | 1/1954 | Riblet | 333/114 |
| 2,981,948 | 4/1961 | Kurtz | 342/153 X |
| 3,434,139 | 3/1969 | Algeo | 343/778 |
| 3,453,636 | 7/1969 | Perini et al. | 333/114 X |
| 3,518,576 | 6/1970 | Algeo | 333/114 |
| 3,824,500 | 7/1974 | Rothenberg | 333/136 |
| 3,906,502 | 9/1975 | Connolly | 343/853 X |
| 3,924,206 | 12/1975 | Fassett | 333/109 X |
| 4,303,898 | 12/1981 | Kinsey et al. | 333/114 |

OTHER PUBLICATIONS

Lopez, Alfred R.; "Monopulse Networks for Series Feeding an Array Antenna"; *IEEE Transactions on Antennas & Propogation;* vol. AP-16, No. 4, Jul. 1968; pp. 436–440.

*Primary Examiner*—Eugene R. LaRoche
*Assistant Examiner*—Benny T. Lee
*Attorney, Agent, or Firm*—Thomas A. Runk; A. W. Karambelas

[57] ABSTRACT

A compact, dual series waveguide feed network is disclosed which has application to monopulse radar antennas and is usable in applications requiring compact and light weight feed networks. The network in accordance with the invention uses phase shifters at the phase reversal points of the secondary (42) feed lines to establish a 180° relative phase difference with the corresponding phase reversal point of the primary feed line. No phase shifters are used in the crossguide feed lines (44). Because of the invention's phase shifter arrangement, crossguide lines (44) may be located directly opposite each other instead of being staggered as in prior techniques; hence the size of the network is reduced and resolution is increased. Also, the primary and secondary feed lines may be located closer together because there are no phase shifters with associated matching and transition devices located in the crossguide feed lines. Tuning is simplified because of the fewer number of phase shifters used and simple waveguide tuning screws may be used in one embodiment.

20 Claims, 5 Drawing Sheets

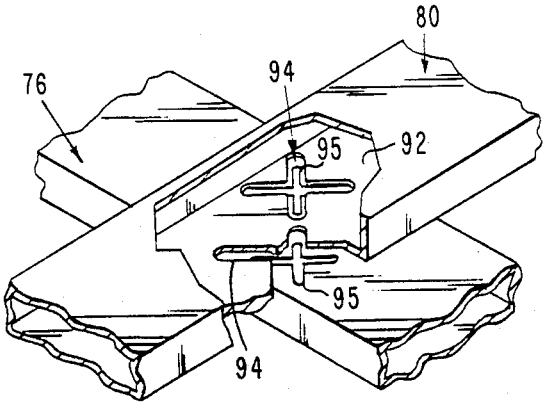
Fig. 5.
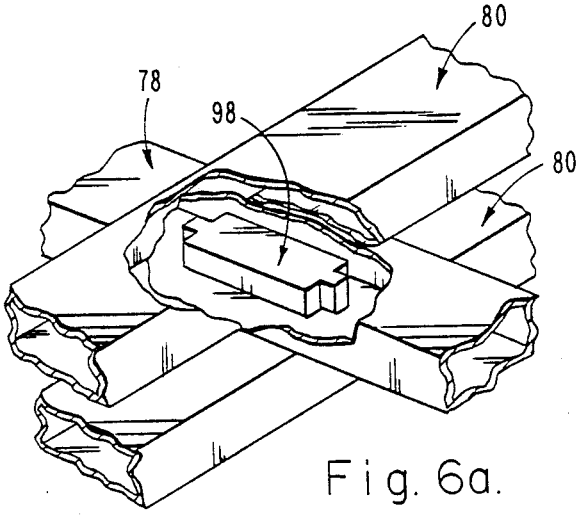
Fig. 6a.
Fig. 6b.
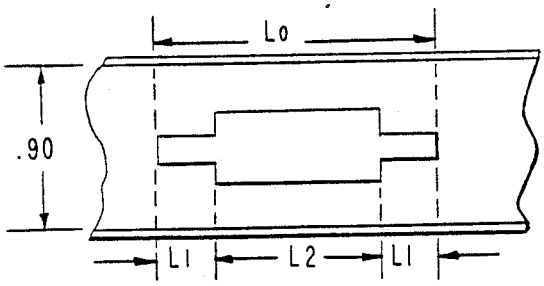

COMPACT DUAL SERIES WAVEGUIDE FEED

This invention was made with Government support under Contract No. DAAK20-83-C-0885 awarded by the Department of the Army. The Government has certain rights in this invention.

BACKGROUND OF THE INVENTION

The invention relates to means for energy transmission and distribution and more particularly, to a dual series-feed network usable for antennas.

Typically, a dual series, center-fed, waveguide ladder network for feeding a monopulse array antenna consists of a symmetrical network having a primary line, a secondary line, N crossguide lines, N phase shifters, and 2N crossguide directional couplers; where N is the number of crossguide lines coupling the primary and secondary lines to the antenna elements. Typically, the primary and secondary lines are parallel to each other and the crossguide lines are perpendicular to and interconnect both the primary and secondary lines.

In the typical application, coupling devices feed the primary line with the sum excitation signal and feed both the primary and secondary lines with the difference excitation signal. Excitation of each antenna element in the transmit mode of operation is obtained by using directional couplers to sequentially tap off power from the primary and secondary lines and using the crossguide lines to conduct that power to the antenna elements. In the transmit mode, the sum and difference excitation signals are independently generated and applied to the primary and secondary lines as described above so that with the introduction of the proper phase shifts, the desired power distribution for radiation from the antenna elements is created. In the receive mode of operation, this process works in reverse. The received power distribution from the antenna elements is subjected to respective phase shifts, if any, and is conducted to the primary and secondary lines by directional couplers. In the primary and secondary lines, the received, phase shifted energy is separated vectorially into the sum and difference excitation signals by the center feed coupling devices.

Feeding the independent sum and difference excitation signals to the primary and secondary lines as described above creates in each a pair of "phase reversal points," one of the pair being located on one side of the center feed device and the other of the pair being located on the other side of the center feed device. At these phase reversal points, the amplitudes of the sum and difference signals are equal in magnitude.

In order to create a difference power distribution at the antenna elements, a phase inversion is introduced beyond the phase reversal points to result in the desired vectorial addition of the signals. A prior technique for introducing this 180° phase differential is the inclusion of a dielectrically loaded, waveguide-section type phase shifter in each of the crossguide lines disposed after this phase reversal point. In this technique, the crossguide lines disposed between the center feed device and the phase reversal point impose 180° phase shift while those crossguide lines outside of the phase inversion point impose 0° phase shift.

In this prior embodiment, crossguide lines were coupled to both sides of the primary and secondary lines thus forming a structure resembling a "double ladder." That is, a first crossguide line would link the first broad wall of the primary line with the first broad wall of the secondary line and a second crossguide line would link the second broad wall of the primary line with the second broad wall of the secondary line. Therefore, the first and second crossguide lines were on opposite sides from each other of both the primary and secondary lines. Their locations on those sides, however, are restricted. Locating the phase shifters in the crossguide lines resulted in a potential for interference among the phase shifter fields. Consequently, crossguide lines could not be located directly opposite one another, and in most cases could not even overlap. They would be staggered in relation to one another to avoid possible phase shifter interference. This requirement of staggering resulted in the crossguide lines on the same side of the main lines being spaced relatively far apart because enough room had to be reserved between them to accommodate the respective crossguide lines on the opposite side. As a result, when this arrangement was utilized in prior radar applications, such as in a monopulse radar system, the resolution of the system was degraded.

A further problem exists with the above technique where a phase shifter is disposed in each crossguide line. Due to signal perturbations and inaccuracies in the phase shifters, they must be individually tuned relative to the neighboring phase shifters to maintain the 180° phase difference on either side of the phase reversal point. As is well known to those skilled in the art, individual tuning is time consuming and relatively expensive. Further disadvantages of this technique include the relatively heavy weight of the feed resulting from the use of so many phase shifters, the expense of so many phase shifters, and the manufacturing difficulties involved in installing a phase shifter in each crossguide line. Another disadvantage is the relatively large size because of the physical dimensions of the matching and transition structures that are required in each crossguide feed line for well matched phase shifters. In this prior technique, not only are the crossguide feed lines located relatively far apart due to the staggering requirement, but the primary and secondary feed lines are also located relatively far apart to accommodate the size of the phase shifter and its transitions and matching devices used in each crossguide feed line. This overall large size made the prior technique network unsuitable for many airborne applications.

It is an object of the invention to provide a dual series waveguide feed network which overcomes most, if not all, of the above disadvantages of the prior techniques.

It is also an object of the invention to provide a dual series feed network which uses fewer phase shifters than prior techniques but which has performance characteristics equal to or better than prior techniques.

It is also an object of the invention to provide a dual series feed network which does not require the location of phase shifters in the crossguide lines, but which uses only a pair of phase shifters located in the secondary line to achieve the desired energy distribution at the antenna elements.

It is also an object of the invention to provide a dual series feed network which locates the crossguide lines closer together and the primary and secondary lines closer together than in prior techniques thereby offering more compactness and higher resolution in certain applications.

It is also an object of the invention to provide a dual series feed network which uses double crossguide couplers to couple the crossguide lines opposite one another to achieve greater compactness.

SUMMARY OF THE INVENTION

The invention provides a compact, dual series-feed, waveguide network comprising primary and secondary feed lines which are parallel to each other, and a plurality of crossguide feed line which are perpendicularly disposed in relation to the primary and secondary feed lines. One end of each of the crossguide feed lines terminates in the antenna elements and the other end of each of the crossguide feed lines terminates in a load means. In one embodiment, waveguide crossguide couplers are used to connect the crossguide feed lines with the primary and secondary feed lines. The primary feed line is fed with the sum and the difference signals while the secondary feed line is fed with only the difference signal, and in one embodiment, both primary and secondary feed lines are center fed. In the invention, phase control is accomplished by disposing a pair of phase shifting means at the phase reversal points in the secondary line to impose a phase shift of 180° relative to the phase at the corresponding phase reversal points in the primary line. At the position of the phase shifting means in the secondary line, no crossguide coupler is used in the disclosed embodiment.

Because phase shifters are not located in the crossguide feed lines as in prior techniques, a feed network in accordance with the invention need not have staggered crossguide feed lines. In the invention, the crossguide feed lines may be placed exactly opposite each other across the primary and secondary lines. Also, in the invention, the primary and secondary feed lines may be located closer together because the crossguide feed lines do not include any phase shifter matching or transition means as in prior techniques. Therefore, both the crossguide feed lines and the primary and secondary lines may also be placed more closely together thereby yielding a more compact feed network and enabling higher resolution in an application such as a monopulse antenna.

Because only two phase shifters are used in the preferred embodiment, the weight of the feed network is less than the prior techniques and manufacturing is facilitated. The compactness and lighter weight make a feed network in accordance with the invention suitable for airborne use.

BRIEF DESCRIPTION OF THE DRAWINGS

Further features, advantages, and objects of the invention may be understood from the following detailed description taken in conjunction with the accompanying drawings in which:

FIG. 5 is a cut-away, perspective view of a crossguide directional coupler which is usable in the invention;

FIG. 6*a* is a cut-away, perspective view of a phase shifter usable in the invention showing its placement in the secondary line; and FIG. 6*b* is a top view of the phase shifter of FIG. 6*a* showing its dimensions in relation to the surrounding waveguide structure.

DETAILED DESCRIPTION OF THE INVENTION

Figure 1:
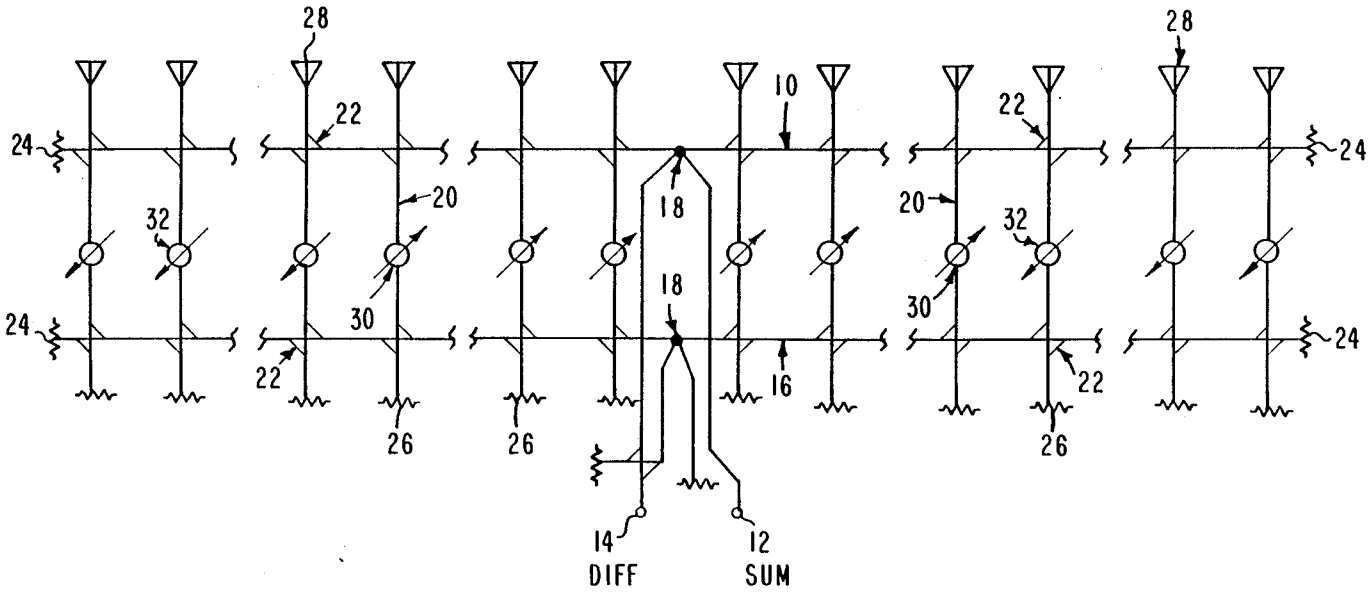
Fig. 1. (PRIOR ART)
FIG. 1 is a schematic diagram of a prior art waveguide dual series-feed network usable in a monopulse radar antenna.

Referring now to the drawings with more particularity wherein like reference numerals designate like or corresponding elements among the several views, there is shown in FIG. 1 a schematic diagram of a prior art waveguide, dual series-feed network. The primary feed line 10 is fed by the sum port 12 and difference port 14 while the secondary line 16 is fed by the difference port 14 alone. Both are center fed. Hybrid junctions 18, such as "Magic T's," are used to couple the respective signals to the primary 10 and secondary 16 lines. The overall network is substantially symmetrical about these hybrid junctions 18.

The primary line 10 and secondary line 16 are interconnected by way of a plurality of crossguide lines 20 and crossguide directional couplers 22. Although there are many of these devices shown in FIG. 1, only a few are designated by numerals in order to retain clarity in the figure. Both ends of both the primary line 10 and secondary line 16 are terminated with termination means 24 such as resistive terminations which are matched to the real portion of the characteristic impedance of the waveguide lines.

Each of the crossguide lines 20 have termination means 26, such as resistive terminations, at one end while their other ends are used to feed the antenna radiating/receiving elements 28. Each of the crossguide lines 20 also contains either a 180° phase shifter 30 or a 0° phase shifter 32. The 180° phase shifters 30 are used in the crossguide lines located between the center feed point and the phase reversal points of the secondary line.

Figure 2:
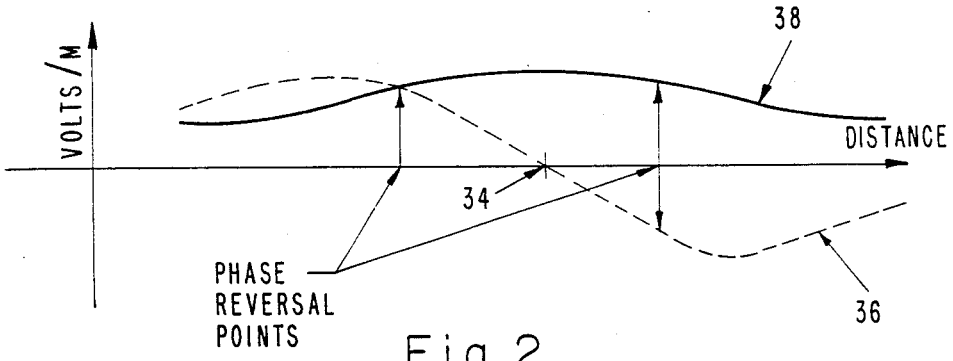
FIG. 2 is a graph of the voltage/meter versus distance distribution of the sum and difference excitation signals at the antenna elements.

The phase reversal point is the point at which the amplitudes of the sum and difference excitation signals are equal in magnitude. This point is illustrated diagrammatically in FIG. 2. In FIG. 2, the ordinate axis represents voltage/meter at the antenna elements and the abscissa axis represents the distance along the primary and secondary feed lines. The center feed point 34 corresponds to the point where the respective hybrids 18 feed the primary 10 and secondary line 16 in FIG. 1. The points along the abscissa where the difference excitation signal 36 and the sum excitation signal 38 have equal magnitudes are the phase reversal points. As shown in FIG. 2, there are two such points which straddle the center feed point 34.

The 180° and 0° phase shifts imparted by the phase shifters 30 and 32, respectively, represent the comparative phase shift difference of the sum of the induced phase shifts from the phase shifter 30 or 32, its respective crossguide line 20, and its respective crossguide directional couplers 22. Hence, due to differences in the crossguide lines 20 and crossguide directional couplers 22, each of the phase shifters 30, 32 must be individually tuned.

Figure 3:
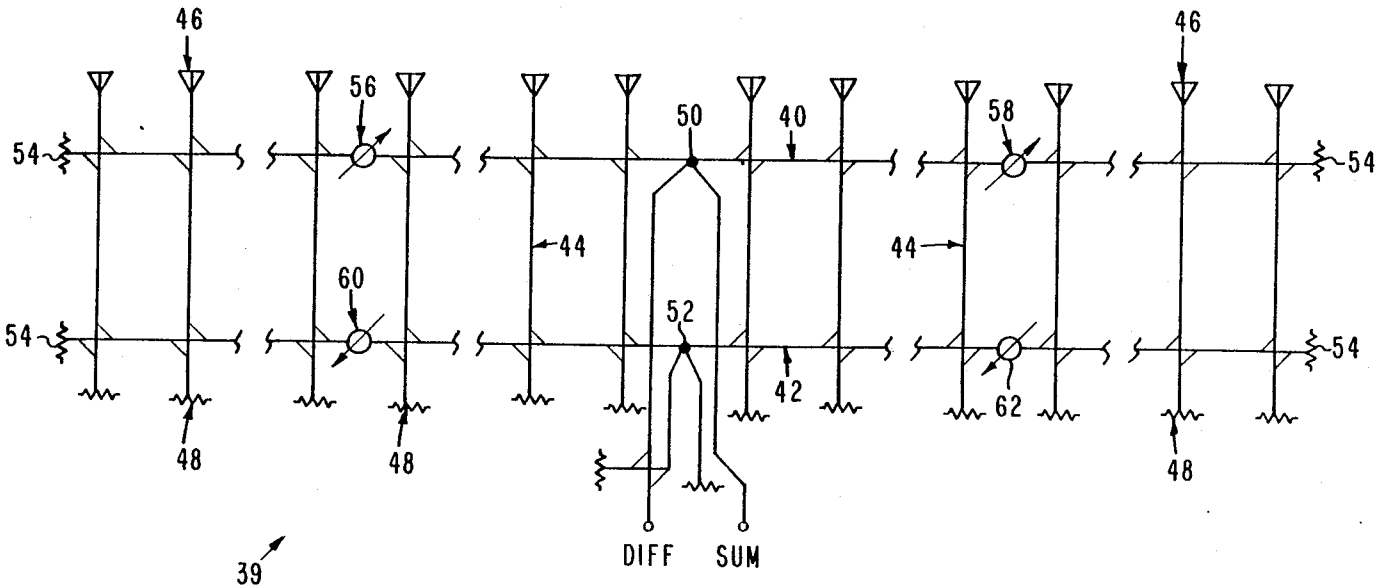
FIG. 3 is a schematic diagram of an embodiment in accordance with the invention showing the location of phase shifters in the primary and secondary lines and the technique of center feeding these lines with the sum and difference signals.

In a dual series, waveguide feed in accordance with the invention, the above problems have been lessened if not eliminated. Referring to FIG. 3, there is shown a feed network 39 in accordance with the invention. As in the prior art FIG. 1, there is a primary feed line 40, a secondary feed line 42, and a plurality of crossguide feed lines 44. Also, as in the prior art shown in FIG. 1, the ends of the crossguide feed lines adjacent the primary line 40 are coupled to radiator/receiver devices 46 while the opposite ends, i.e., those adjacent the secondary line, are terminated in load devices 48. The primary feed line 40 is center fed by the sum and difference excitation signals through a hybrid device 50 such as a magic T and the secondary feed line 42 is center fed by the difference excitation signal also through a hybrid device 52. The primary and secondary feed lines 40, 42 are terminated at their ends with appropriate termination devices 54.

In a network in accordance with the invention, phase shifters are not located in the crossguide feed lines 44 as in the discussed prior technique, but the necessary phase control is established instead by achieving a 180° phase difference between each phase reversal point in the primary feed line and the corresponding phase reversal point in the secondary line. For explanation purposes, FIG. 3 shows two phase shifters 56 and 58 in the primary line and two phase shifters 60 and 62 in the secondary line. In the primary line these phase shifters are referred to as 0° phase shifters to set up a reference phase relative to the secondary line. Thus, phase shifter 56 sets a 0° phase shift while its corresponding phase shifter 60 in the secondary line sets a 180° phase shift. A like arrangement occurs on the other side of the center feed points where the primary feed line phase shifter 58 sets a 0° phase shift and its corresponding secondary line phase shifter 62 sets a 180° phase shift. As is discussed below, there may actually be no phase shifters in the primary line. Instead, the phase shifters in the secondary line 60 and 62 are set to be at 180° relative phase from the phase reversal points in the primary line.

Figure 4:
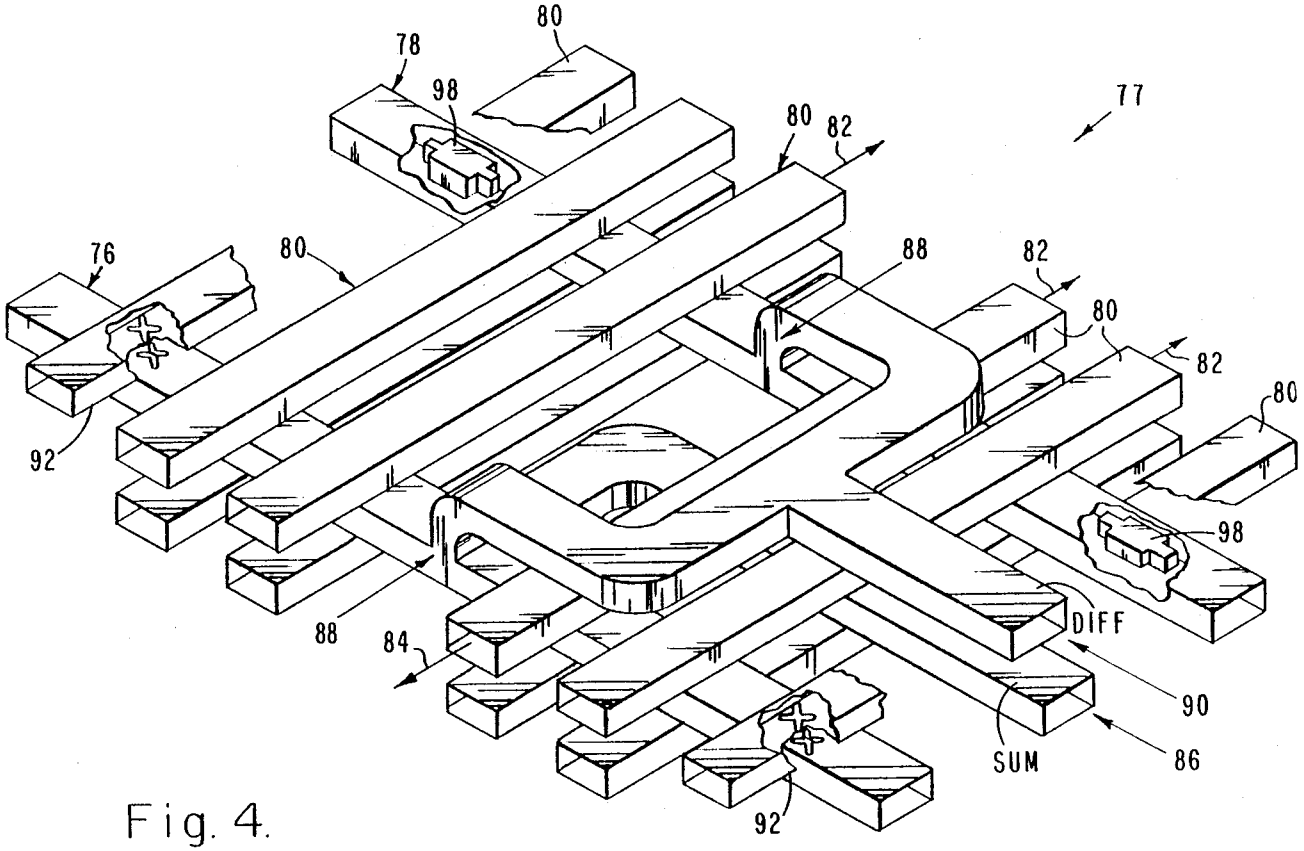
FIG. 4 is a perspective view of a portion of a waveguide, dual series-feed network in accordance with the invention showing the placement of the crossguide feed lines opposite one another resulting in a more compact feed network.

A perspective view of a dual series waveguide feed 77 in accordance with the invention is shown in FIG. 4. Primary feed line 76 and secondary feed line 78 are interconnected by means of a plurality of crossguide feed lines 80. As in prior embodiments discussed above, one end 82 of each of the crossguide feed lines is coupled to a termination (not shown) and the opposite end 84 is coupled to an antenna element (not shown), such as a radiating/receiving element. The sum excitation signal is fed to the primary line 76 via a waveguide 86 and hybrid 88 combination and the difference excitation signal is fed to both the primary and secondary lines 76, 78 via waveguide 90 and hybrid 88 combinations.

Crossguide feed lines 80 are coupled to both the primary and secondary feed lines 76, 78 by means such as crossguide couplers 92, two of which are shown in broken away form. A crossguide coupler usable for this purpose is shown in greater detail in FIG. 5. In the crossguide coupler 92 shown, there are two crossed slots 94 in the broad waveguide wall of the crossguide coupler 80 which are aligned with two crossed slots 95 in the broad waveguide wall of the secondary feed line 76. The same crossguide coupler may be used to connect the same crossguide feed line 80 to the secondary feed line 78. In the interest of clarity of the drawings, only two such crossguide couplers have been shown. Such crossguide couplers are well known to those skilled in the art. See, for example, U.S. Pat. No. 4,303,898 to Kinsev et al.

A main feature of the invention is the placement of a relatively few phase shifters in the secondary feed line. As discussed above, these phase shifters are positioned at the phase reversal points as shown in FIG. 3 by the numerals 60 and 62. It has been found that as long as a "relative phase difference" of 180° is maintained between the phase shifter pairs 60 and 56, and also between 62 and 58, the desired performance can be achieved. In one embodiment, this is implemented by omitting the 0° phase shifters 56 and 58 in the primary line and using the two 180° phase shifters 60 and 62 in the secondary line only. As shown in FIG. 4 in broken away form, a pair of phase shifters 98 have been located in the secondary line 78. These phase shifters 98 induce a phase shift of 180° in the secondary line with respect to the primary line.

The crossed slots of the crossguide couplers at the point of location of the phase shifters 98 have been short-circuited, i.e., no slots at these points are used. It has been found that at these point, the coupling ratio of the crossguide coupler in the secondary line is substantially zero. Therefore, there would be only a negligible amount of energy coupled to these couplers and the couplers are very close to short circuit. Hence, these are considered to be suitable positions for phase shifters. In the embodiment shown, the crossguide coupler slots 92 are still used in the primary line but no 0° phase shifters are inserted at these locations as mentioned above.

It has also been found that actually placing the phase shifters in the secondary line results in no discontinuity in the sum as well as difference distributions and no dispersive change over a specified bandwidth. The location of phase shifters 98 in the secondary line 78 also does not appreciably degrade the resolution of the dual series feed in accordance with the invention in an application such as a monopulse system, because, as stated above, only a negligible amount of energy would be conducted into the element at this point at the secondary line 78 in any case.

One of the primary advantages of a feed network in accordance with the invention is the ability to locate crossguide feed lines closer together. Because there are no phase shifters in the crossguide feed lines, there will be no phase shifter interaction when these feed lines are placed close together. They may even be placed directly opposite one another across the primary and secondary feed lines. This arrangement is shown in FIG. 4 where crossguide feed lines are arranged in pairs. At each location along the primary and secondary lines 76, 78, a pair of crossguide feed lines 80 are located opposite each other. The crossguide directional couplers 92 used in this configuration are double crossguide directional couplers because they couple each main feed line to two crossguide feed lines. A double crossguide directional coupler may be implemented by using two crossguide couplers similar to that shown in FIG. 5.

An example of a phase shifting means usable in the invention is the dielectric loaded waveguide section which is well known to those skilled in the art. Such a design is presented in FIG. 6*a* where two crossguide feed lines 80 are shown crossing the secondary feed line 78. The dielectric loading is shown by numeral 98. FIG. 6*b* presents certain dimensions of the dielectric loading 98 where:

L0=1.467 inch
L1=0.311 inch

L2=0.845 inch

The waveguide 78 used in this embodiment is WR 90 and the dielectric 98 is of Rexolite made by Reynolds & Taylor, Inc., 2109 S. Wright St., Santa Ana, Calif., 92705. Further dimensions, composition of the dielectric material, and means for mounting the dielectric material in the waveguide are well known to those skilled in the art and are not discussed further herein. For a reference which discusses such design considerations for dielectric loaded waveguide sections used as phase shifters and design considerations relevant to crossguide couplers, refer to Alfred R. Lopez, "Monopulse Networks for Series Feeding an Array Antenna," IEEE Transactions on Antennas and Propagation, Vol. AP-16, No. 4, July 1968, pp. 436–40, and William R. Jones & Edward C. DuFort, "On The Design of Optimum Dual-Series Feed Networks," IEEE Transactions on Microwave Theory and Techniques, Vol. MTT-19, No. 5, May 1971, pp. 451–458.

Even though only two phase shifters are used, some tuning may be required. Phase shifts induced by the crossguide lines 80 and crossguide couplers 92 may be tuned out with simple waveguide tuning pins placed along the broad wall of the secondary feed line 78.

Thus a new and useful dual series waveguide feed network has been shown and described in detail. A network built in accordance with the invention has the compactness and high performance desired of networks to be used in airborne applications. Advantages of networks built in accordance with the invention include: cost reduction; lighter weight; compactness; good phase tracking; lower loss; and high power handling capability due to the use of waveguide.

Although an embodiment of the invention has been described in detail, it is anticipated that modifications and variations may occur to those skilled in the art which do not depart from the inventive concepts. The above description is meant to be taken as example only and not limitation and so the invention will include such modifications and variations unless limited otherwise by the appended claims.

What is claimed is:

1. A waveguide feed network comprising:

a primary feed line having first and second ends;

a secondary feed line substantially parallel to the primary feed line, having first and second ends;

a plurality of crossguide feed lines which are substantially perpendicular to said primary feed line;

coupler means for coupling selected ones of said crossguide feed lines to the primary and secondary feed lines;

first feed means for feeding the primary feed line at a point between said first and second ends such that a first primary line phase reversal point lies between said first feed means and said first end and a second primary line phase reversal point lies between said first feed means and said second end;

second feed means for feeding the secondary feed line at a point between said first and second ends such that a first secondary line phase reversal point lies between said second feed means and said first end and a second secondary line phase reversal point lies between said second feed means and said second end; and phase shifter means for imparting a relative phase difference of substantially 180° between said first secondary line phase reversal point and said first primary line phase reversal point and for imparting a phase difference of substantially 180° between said second secondary line phase reversal point and said second primary line phase reversal point.

2. The waveguide feed network of claim 1 wherein the phase shifter means comprises a phase shifter disposed at each of the phase reversal points in the secondary feed line, each phase shifter establishing a 180° phase difference between its phase reversal point and the corresponding phase reversal point in the primary feed line.

3. The waveguide feed network of claim 2 wherein the coupler means couples those crossguide feed lines which cross the phase reversal points only to the primary feed line and not to the secondary feed line.

4. The waveguide feed network of claim 1 wherein the coupler means comprises a crossguide coupler.

5. The waveguide feed network of claim 4 wherein the crossguide coupler comprises a pair of crossed slots.

6. The waveguide feed network of claim 1 wherein said crossguide lines are arranged in pairs, and wherein one line of each pair is disposed directly opposite and across the primary and secondary feed lines from the other line of that pair.

7. The waveguide feed network of claim 1 wherein the primary and secondary feed lines are center fed.

8. The waveguide feed network of claim 7 wherein sum and difference excitation signals are fed by the first feed means to the primary feed line and difference excitation signals are fed by the second feed means to the secondary feed line.

9. The waveguide feed network of claim 1 wherein the crossguide feed lines are arranged in pairs equally spaced along the primary and secondary lines and wherein one line of each pair is located directly opposite and across the primary and secondary lines from the other line of that pair.

10. A waveguide feed network which processes sum and difference signals, comprising:

a primary feed line having first and second ends;

a secondary feed line substantially parallel to the primary feed line, having first and second ends;

a plurality of crossguide feed lines which are substantially parallel to each other and are substantially perpendicular to said primary feed line;

coupler means for coupling the crossguide feed lines to the primary and secondary feed lines except at first and second phase reversal points in the secondary feed line;

first feed means for feeding the sum and difference excitation signals to the primary feed line at a point between said first and second ends such that a first primary line phase reversal point lies between said first feed means and said first end and a second primary line phase reversal point lies between said first feed means and said second end;

second feed means for feeding the difference excitation signal to the secondary feed line at a point between said first and second ends such that a first secondary line phase reversal point lies between said second feed means and said first end and a second secondary line phase reversal point lies between said second feed means and said second end;

a first phase shifter disposed at the first secondary line reversal point for imparting a relative phase shift of substantially 180° between said first secondary line phase reversal point and said first primary line phase reversal point; and a second phase shifter disposed at the second secondary line phase reversal point for imparting a relative phase shift of substantially 180° between said second secondary line phase reversal point and said second primary line phase reversal point.

11. The waveguide feed network of claim 10 wherein the coupler means comprises a crossguide coupler.

12. The waveguide feed network of claim 11 wherein the crossguide coupler comprises a pair of crossed slots.

13. The waveguide feed network of claim 10 wherein said crossguide lines are arranged in pairs, and wherein one line of each pair is disposed directly opposite and across the primary and secondary feed lines from the other line of that pair.

14. The waveguide feed network of claim 10 wherein the primary and secondary feed lines are center fed.

15. The waveguide feed network of claim 14 wherein the crossguide feed lines are arranged in pairs equally spaced along the primary and secondary lines and wherein one line of each pair is located directly opposite and across the primary and secondary lines from the other line of that pair.

16. A waveguide feed network which processes sum and difference signals, comprising:

a primary feed line;

a secondary feed line substantially parallel to the primary feed line;

a plurality of crossguide feed lines which are substantially parallel to each other and are substantially perpendicular to said primary and said secondary feed lines;

crossguide couplers which couple the crossguide feed lines to the primary and secondary feed lines except at first and second phase reversal points in the secondary feed line;

a first feed for feeding the sum and difference excitation signals to the primary feed line at its center such that a first primary line phase reversal point lies between said first feed and a first end of the primary feed line and a second primary line phase reversal point lies between said first feed and a second end of the primary feed line;

a second feed for feeding the difference excitation signal to the secondary feed line at its center such that a first secondary line phase reversal point lies between said second feed and a first end of the secondary feed line and a second secondary line phase reversal point lies between said second feed and a second end of the secondary feed line;

a first phase shifter disposed at said first secondary line phase reversal point for imparting a relative phase shift of substantially 180° between said first secondary line phase reversal point and said first primary line phase reversal point; and a second phase shifter disposed at said second secondary line phase reversal point for imparting a relative phase shift of substantially 180° between said second secondary line phase reversal point and said second primary line phase reversal point.

17. The waveguide feed network of claim 16 wherein each crossguide coupler comprises a pair of crossed slots.

18. The waveguide feed network of claim 16 wherein said crossguide lines are arranged in pairs, and wherein one line of each pair is disposed directly opposite and across the primary and secondary feed lines from the other line of that pair.

19. The waveguide feed network of claim 16 wherein the crossguide feed lines are arranged in pairs equally spaced along the primary and secondary lines and wherein one line of each pair is located directly opposite and across the primary and secondary lines from the other line of that pair.

20. The waveguide feed network of claim 16 wherein each phase shifter comprises dielectric loading of the secondary feed line at the respective phase reversal point.

* * * * *